US005335812A

United States Patent [19]

Boller

[11] Patent Number: 5,335,812

[45] Date of Patent: Aug. 9, 1994

[54] DRINKING VESSEL LID HAVING A DEFINED STRAW PUNCTURABLE AREA

[75] Inventor: Peter K. Boller, North York, Canada

[73] Assignee: Lily Cups Inc., Scarborough, Canada

[21] Appl. No.: 143,014

[22] Filed: Oct. 29, 1993

[30] Foreign Application Priority Data

Sep. 21, 1993 [CA] Canada ..... 2106653

[51] Int. Cl.[5] ..... B65D 41/46; A47G 19/22

[52] U.S. Cl. ..... 220/709; 220/713; 220/265; 220/267; 220/268; 229/103.1; 215/1 A; 215/250; 215/253

[58] Field of Search ..... 220/703, 705, 709, 711, 220/229, 265, 266, 267, 268, 277; 229/103.1; 215/1 A, 229, 250, 253

[56] References Cited

U.S. PATENT DOCUMENTS

| | | | |
|---|---|---|---|
| 3,048,317 | 8/1962 | Cochrane et al. | 220/713 X |
| 3,171,580 | 3/1963 | Davis et al. . | |
| 3,524,566 | 8/1970 | Parks | 220/713 X |
| 3,927,794 | 12/1975 | Erdman . | |
| 4,018,178 | 4/1977 | Klein et al. | 220/268 X |
| 4,441,623 | 4/1984 | Antoniak | 220/711 |
| 4,714,173 | 12/1987 | Ruiz | 229/103.1 X |
| 4,948,009 | 8/1990 | Sawatani | 220/229 |
| 5,183,172 | 2/1993 | Boller | 220/270 |

*Primary Examiner*—Allan N. Shoap
*Assistant Examiner*—Vanessa Caretto
*Attorney, Agent, or Firm*—Lowe, Price, LeBlanc & Becker

[57] ABSTRACT

A lid formed from plastics material and used as a closure for a drinking vessel is disclosed. The lid includes a main disc closure portion and a perimeter wall for mounting the lid on the open top end of the vessel. The lid is characterized by a rupturable depression in the main disc portion which receives and can be ruptured by one end of a drink through straw when pushed by hand. The depression has an annular sleeve like sidewall which terminates in a bottom end wall and which at their juncture provides a predetermined tear line. The depression also includes a formation in each portion of the side and bottom wall which extends from a first selected area of the sidewall in a direction towards another selected area in the sidewall which is spaced from the first area. The formation is engageable with the one end of the straw and when the straw is pushed into the depression, initiates rupture in the depression adjacent the second area.

7 Claims, 2 Drawing Sheets

DRINKING VESSEL LID HAVING A DEFINED STRAW PUNCTURABLE AREA

FIELD OF INVENTION

This invention relates generally to a lid for a drinking vessel and more particularly to a lid having a defined drinking straw puncturable area.

BACKGROUND OF INVENTION

Disposable plastic lids for drinking cups are well known for hot beverages, for cold beverages and for both. For cold beverages one or more straw openings are provided. One means of providing an opening for a straw is to fracture the lid surface with a "cross" type or "circular disc" type cut through which the straw can quite readily be inserted. Another known means, disclosed in U.S. Pat. No. 3,171,580 issued Mar. 2, 1965, is to have a circular area raised up from the plane of the lid and provided with a weakened wall section that can be torn by finger nail pressure. The raised portion of the lid can then be lifted providing an opening for inserting a straw into the container covered by the lid.

A container cap is also known from the teachings of U.S. Pat. No. 3,927,794 issued Dec. 23, 1975 wherein a defined area within lines of weakness, and in one embodiment in a recess, can, by finger pressure, be pushed into the container to provide an opening. The cap is intended for cans, bottles or jars through which drinking or pouring access can be established by means of the depressible tab. The patent is directed to a protrusion on the tab positioned and correlated with the opening so as to engage the underside of the lid when the tab is depressed so as to maintain the tab in its depressed or open position.

Lids for hot drinks have typical features such as sip openings, flip back, and vent hole and in a lid suitable for both cold and hot drinks a straw insertion area is also be provided.

SUMMARY OF INVENTION

A principle object of the present invention is to provide a straw puncturable defined area in a lid.

A further principle object of the present invention is to provide a straw puncturable defined area in a lid wherein the puncturable area is free from cuts through the lid and thereby avoids leakage of the contents of the container prior to being punctured.

A further principle object of the present invention is to provide a lid suitable for both cold and hot drinks that has all the typical features for not drinks of a sip opening, flip back, vent hole and further including a straw insertion section in a defined depressed area in the lid that is puncturable by the blunt end of a drinking straw.

In keeping with the foregoing there is provided in accordance with the present invention a lid for a drinking vessel, said lid being formed from plastics material and having a main disc closure portion for covering an open top end of said vessel and perimeter wall means for mounting the lid on said open top end of said vessel, said lid being characterized by a rupturable depression in said main disc portion and which is capable of receiving and being ruptured by one end of a drink through straw pushed endwise by hand, said depression including an annular sleeve like sidewall terminating in a bottom end wall and which walls at their juncture provide a predetermined tear line, said depression further including a formation in each of a portion of said side and bottom walls and extending from a first selected area of said side wall in a direction toward another second selected area of said side wall spaced from said first area, said formation being engageable with said one end of the straw and providing an area of reinforcement that directs initiation of the rupture adjacent said second area.

The foregoing lid preferably also includes lines of weakness defining a flap that can be torn and pivoted to overlie a central portion of the lid on which there is a lock to retain the flap in the open position and also further including a vent hole through the lid.

LIST OF DRAWINGS

The invention is illustrated by way of example in the accompanying drawings wherein.

DESCRIPTION OF PREFERRED EMBODIMENT

Figure 1:
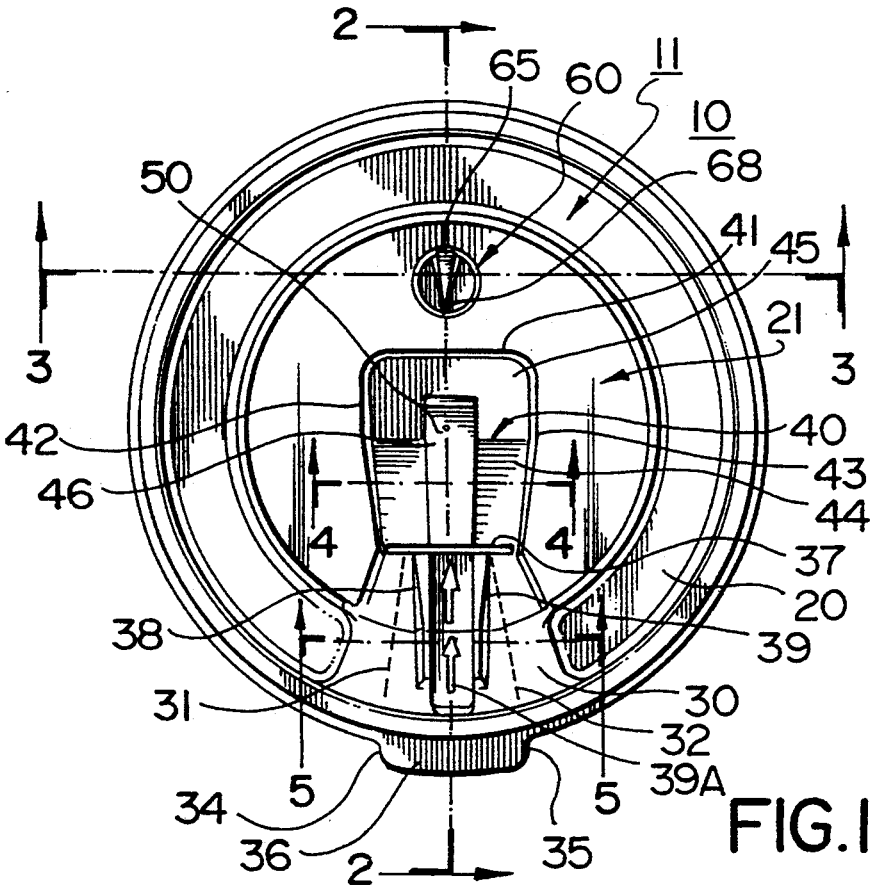
FIG. 1 is a top plan view of the preferred lid, constructed in accordance with the present invention, for both hot and cold beverages.
Figure 2:
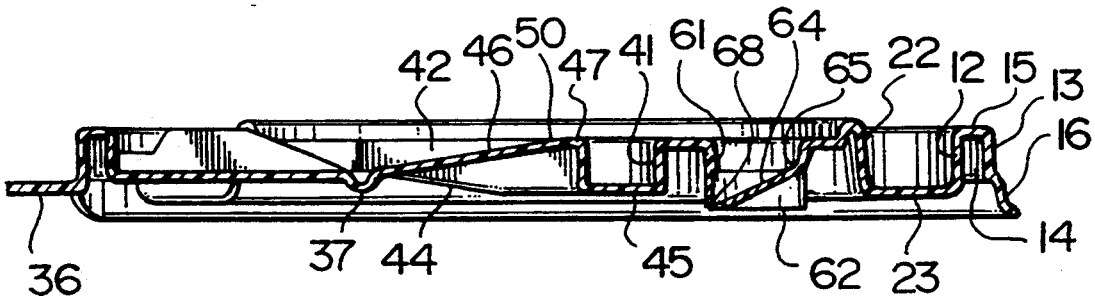
FIG. 2 is a sectional view along line 2—2 of FIG. 1.
Figure 3:
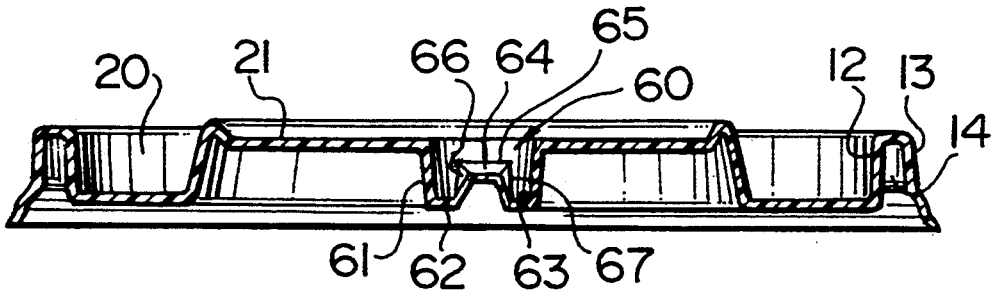
FIG. 3 is a sectional view along line 3—3 of FIG. 1.
Figure 4:
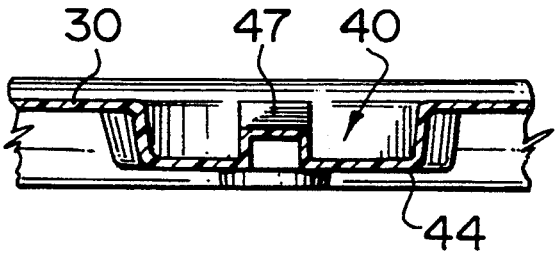
FIG. 4 is a sectional view along line 4—4 of FIG. 1.
Figure 5:
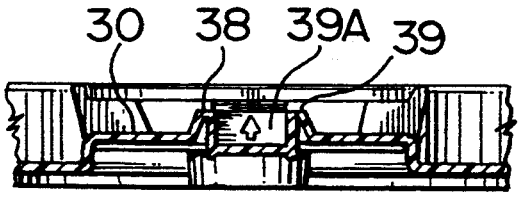
FIG. 5 is a sectional view along line 5—5 of FIG. 1.

Referring to the drawings illustrated is a lid 10 for covering and closing the open upper end of a drinking container (not shown) that may contain either a hot beverage or a cold beverage and which lid includes a central disc portion 11 surrounded about its perimeter by walls 12 and 13 which define a groove 14 on its undersurface. The groove 14 receives an upper open end portion of the container providing a liquid sealed mounting of the lid on the container. The inner and outer sidewalls 12 and 13, which are spaced apart from one another, are joined together by a top wall 15 and the sidewall 13 is flared outwardly at its bottom end as indicated by reference 16.

The central disc portion 11, which covers the open end of the container, extends inwardly from a lower edge of the inner sidewall 12 and includes an outer arcuate channel portion 20 extending around a major portion of a central raised area 21. The channel 20 is defined by the previously described inner side wall 12 and another wall 22 spaced inwardly therefrom. Channel 20 has a bottom wall 23 that is located in a plane spaced downwardly from and parallel to a plane in which the central raised area 21 lies. At a position between these two planes is a third planar area designated 30 that has converging inwardly, spaced apart, defined lines of weakness 31 and 32. These lines of weakness extend from locations in the vicinity of respective opposite ends 34 and 35 of a finger grip lift tab 36 to a defined hinge line 37. Tab 36 projects outwardly from wall 13 and is in a plane approximate that of the channel bottom wall 23.

Located between the lines of weakness 31 and 32 are a pair of upwardly projecting spaced apart protrusions 38 and 39 that define therebetween a channel 39A.

The central raised area 21 has a first depression 40 commencing at the hinge line 37 and extending to an end wall 41. Depression 40 has opposite side walls 42 and 43 and a sloped bottom wall 44 extending to a flat bottom wall 45.

Between the side walls 42 and 43 is an upward protrusion 46 that slopes upwardly from the hinge line 37 to an apex 47 and in proximity of the apex is a through vent hole 50.

The protrusion 46 fits between and frictionally engages spaced apart protrusions 38 and 39 when the lift tab is torn along lines 31 and 32 and pivoted about hinge 37 to an open position. The lines of weakness are preferably perforation free and may be lines of reduced wall thickness or preferably, are formations that direct tearing to occur along a predetermined line. By way of example each line may be defined by a formation that, in cross-section, is an inverted V the apex being the line along which tearing occurs.

In accordance with the present invention the lid is provided with a second depression 60, in the central raised area 21, that can be pierced with the blunt end of a drinking straw. The depression 60 is circular and slightly larger than a conventional 5/16" drinking straw.

The depression 60 tapers inwardly in a direction downwardly and has a side wall 61 and a bottom wall 62. The juncture of walls 61 and 62 is designated 63 and defines a line of weakness or tear line. An upward protrusion on the bottom wall has an upper wall 64 that slopes and merges into the side wall at a position designated 65. The protrusion has opposite side walls 66 and 67 that diverge from one another in a direction toward said position 65. The upper wall slopes downward from the position designated 65 in a direction toward the bottom wall 62 and terminates adjacent a second position on the side wall designated 68 and which is spaced from the position 65. The protrusion is engaged by the blunt end of a straw and as the straw is pushed endwise the force is directed to initiate formation of a tear at said second position 68 along the juncture 63 of the walls 61 and 62.

The lid is made of a plastics material and may be formed from thermoplastics material in a conventional vacuum formation process on a die or it may be formed by injection molding. Stretch of the material and/or mold or die shape can be used to cause a thinner wall thickness to occur along the juncture 63 than either of the walls 61 and 62, The juncture of the walls 65, 66 and 67 of the protrusion with the side wall 61 of the depression provides an area of strength that will ensure no separation of lid material during straw puncturing.

The foregoing provides a hot/cold beverage container lid that has a defined straw puncturable area that doesn't leak liquid prior to puncturing said depression. Other advantages are: Ease of manufacturing, no cutting tool or maintenance costs and a clean appearance with no loose fibres or slivers adhering to the opening which could have been created during the cutting process.

The difficulty in the development was to create an area in the plastic lid surface that was thin enough to be pierced with a 'blunt' straw. Another challenge was that it had to accommodate straw sizes ranging from 3/16 to 5/16 of an inch in diameter.

A third major obstacle was to develop a configuration that would not allow a part of the plastic lid material to be separated from the lid and dropping into the cup when the straw is inserted.

We claim:

1. A lid for a drinking vessel, said lid being formed from plastics material and having a main disc closure portion for covering an open top end of said vessel and a perimeter wall for mounting the lid on said open top end of said vessel, said lid being characterized by a rupturable depression in said main disc portion and which is capable of receiving and being ruptured by one end of a drink through straw pushed endwise by hand, said depression including an annular sleeve like sidewall terminating in a bottom end wall and which walls at their juncture provide a predetermined tear line, said depression further including a formation in each of a portion of said side and bottom walls and extending from a first selected area of said side wall in a direction toward another second selected area of said side wall spaced from said first area, said formation being engageable with said one end of the straw to facilitate initiating the rupture adjacent said second area.

2. A lid as claimed in claim 1, wherein said formation extends interiorly of said depression in a direction upwardly.

3. A lid as claimed in claim 1, wherein said formation extends across a major portion of said bottom wall of the depression.

4. A lid as claimed in claim 1, wherein said formation has a top surface and wherein top surface is inclined downwardly in a direction away from said first area.

5. A lid as claimed in claim 4, wherein said top surface decreases in area in a direction away from said first area.

6. A lid as defined in claim 1 made of a thermoplastic material.

7. A lid as defined in claim 1 formed from thermoplastic sheet material.

* * * * *